US006966557B2

(12) United States Patent
Kirk et al.

(10) Patent No.: US 6,966,557 B2
(45) Date of Patent: Nov. 22, 2005

(54) LIQUID REACTIVE MATERIALS AND METHOD FOR USING SAME IN GAMES AND OTHER APPLICATIONS

(75) Inventors: Dana Scott Kirk, Kearns, UT (US); Shaun D. Mitchell, Salt Lake City, UT (US); Derek Allen Sims, West Jordan, UT (US)

(73) Assignee: Dissolve, LLC, Croydon, PA (US)

( * ) Notice: Subject to any disclaimer, the term of this patent is extended or adjusted under 35 U.S.C. 154(b) by 0 days.

(21) Appl. No.: 11/003,116

(22) Filed: Dec. 3, 2004

(65) Prior Publication Data

US 2005/0098953 A1 May 12, 2005

Related U.S. Application Data

(62) Division of application No. 10/374,753, filed on Feb. 25, 2003, now Pat. No. 6,845,982.

(60) Provisional application No. 60/402,201, filed on Aug. 9, 2002.

(51) Int. Cl.[7] ..... A63D 67/00
(52) U.S. Cl. ..... 273/349
(58) Field of Search ..... 273/349, 350, 273/378, 380

(56) References Cited

U.S. PATENT DOCUMENTS 3,434,717 A * 3/1969 Schwartz ..... 273/349
3,486,752 A * 12/1969 Colvin et al. ..... 273/378
4,533,145 A * 8/1985 Liebman ..... 273/378
4,743,030 A * 5/1988 Auer et al. ..... 273/349
4,744,113 A * 5/1988 Kogut ..... 4/661
4,773,863 A * 9/1988 Douglas, III ..... 434/247
5,411,269 A * 5/1995 Thomas ..... 273/349
5,549,303 A * 8/1996 Kastner ..... 273/349
5,580,063 A * 12/1996 Edwards ..... 273/378
5,626,343 A * 5/1997 Sanders ..... 273/349
5,855,371 A * 1/1999 Sanders ..... 273/349
5,893,562 A * 4/1999 Spector ..... 273/349
5,906,373 A * 5/1999 Sanders ..... 273/349
6,715,763 B2 * 4/2004 Rudell et al. ..... 273/445

* cited by examiner

*Primary Examiner*—Mark S. Graham
(74) *Attorney, Agent, or Firm*—Gibson, Dunn & Crutcher LLP; Stanley J. Gradisar

(57) ABSTRACT

A method for temporarily adhering an image to a surface is shown utilizing liquid soluble substrates that have printed images of liquid insoluble ink. The liquid soluble substrate is positioned on a surface, such as a billboard, sidewalk, parking lot, telephone pole, skin, clothing, etc., and a liquid, typically water, is applied to the liquid soluble substrate and/or to the surface in such a quantity, and at such a temperature, and at such a pressure and velocity so as to be absorbed by the liquid soluble substrate in a sponge-like fashion. As the substrate dries, it takes on the shape of the surface, conforming and adhering to the surface through a mechanical interlock therewith. Various coatings may be applied to extend the longevity of the substrate. The liquid soluble substrate may be removed from the surface by applying a sufficient quantity of liquid at a sufficient temperature, pressure and velocity.

17 Claims, 5 Drawing Sheets

LIQUID REACTIVE MATERIALS AND METHOD FOR USING SAME IN GAMES AND OTHER APPLICATIONS

CROSS REFERENCE TO RELATED APPLICATION

This application is a divisional patent application of application Ser. No. 10/374,753, filed on Feb. 25, 2003, now U.S. Pat. No. 6,845,982 titled "Liquid Reactive Materials And Method For Using Same In Games And Other Applications", now allowed, which is a continuation-in-part of Application No. 60/402,201, filed on Aug. 9, 2002, entitled "Method And System For Temporarily Adhering An Image To A Surface", which are incorporated herein by reference in their entirety.

FIELD OF THE INVENTION

This invention relates to liquid reactive materials used as liquid soluble substrates, and particularly to a method of temporarily adhering an image printed on a liquid soluble substrate to a surface, and more particularly to using liquid soluble substrates with an adhered image in games and other applications.

BACKGROUND OF THE INVENTION

Available from many different suppliers, such as Gilbreth Packaging Systems, liquid soluble paper looks, feels, and tears like ordinary paper. It can be written on, used in photocopy machines, and can be coated, embossed, and printed on. Liquid soluble paper can also be laminated, corrugated, perforated, and made into envelopes, pads, or computer paper. Labels made from liquid soluble paper remove instantly with liquid without scratching or scraping, and without soggy paper or adhesive residue left behind on the surface that the label was applied. Liquid soluble paper can be printed on most web and sheet fed presses, including letterpress, flexography, and dry offset processes. Liquid soluble paper requires no special equipment and accepts water and oil-based inks. Liquid soluble paper can be coated, impregnated, sheeted, or pleated. It can also be slit, perforated, or folded—all using standard converting equipment.

Most liquid soluble paper completely disperses in hot or cold liquid, with water being the most often used liquid. Typically made of cellulose polymers and tackified resins, liquid soluble paper products are simply washed away when no longer needed. They are quickly and easily removed, from even the most inaccessible places, by utilizing a liquid sprayer, squirter, hose or other suitable device.

Although liquid soluble materials are temporary and disposable, they can be made to last for extended periods of time and are strong enough to withstand the most rigorous production processes. They can be easily fabricated into different shapes and sizes and are capable of being printed with the most demanding graphics. Many liquid soluble substrates are biodegradable and contain no preservatives, bactericides, or other harmful substances. Many are also non-toxic, tasteless, and odorless, making them safe for almost any application.

DETAILED DESCRIPTION

Figure 1A:
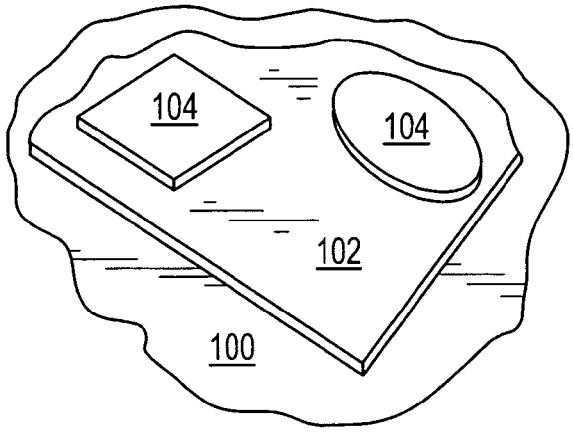
FIGS. 1A, 1B, and 1C show an enlargement of a portion of a liquid soluble substrate having images printed with liquid insoluble ink being applied temporarily to a surface in an embodiment of the present invention.
Figure 1B:
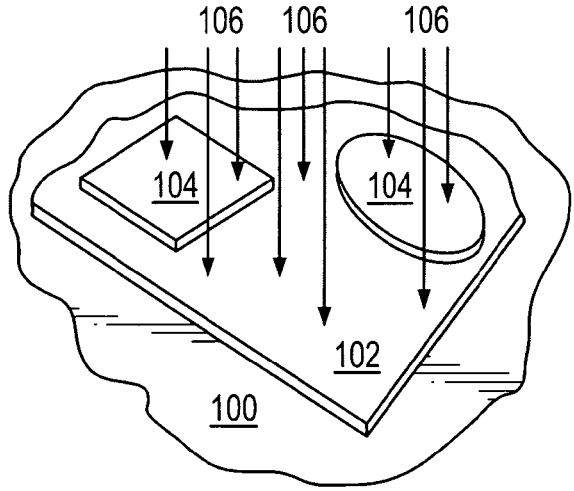
Figure 1C:
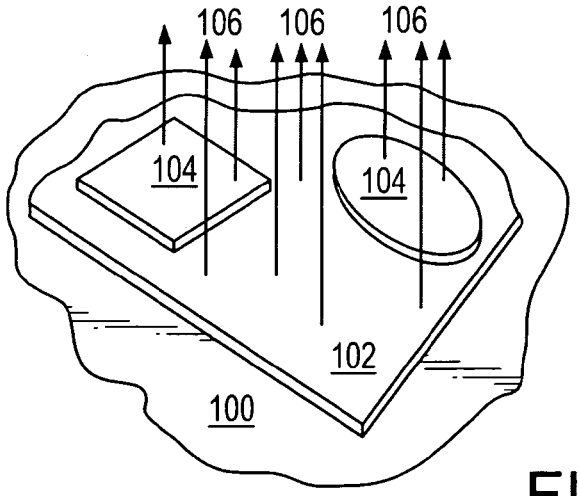

Referring now to the Figures, in which like reference numerals refer to like components thereof, FIGS. 1A, 1B, and 1C show an enlargement of a portion of a liquid soluble substrate having images printed with liquid insoluble ink being applied temporarily to a surface in an embodiment of the present invention. Referring now to FIG. 1A, Liquid Soluble Substrate 102 is positioned on Surface 100 as part of the application process. Liquid Soluble Substrate 102, which is well known in the art, is typically paper, but may also be made of other substances, such as plastic.

Printed on Liquid Soluble Substrate 102 are Ink Images 104. Both Liquid Soluble Substrate 102 and Ink Images 104 are shown with exaggerated depth for clarity of description. The ink used to form Ink Images 104 is typically a water insoluble ink, and may be applied to Liquid Soluble Substrate 102 in any of the ways previously described. The water insoluble ink may be solvent based, UV (ultraviolet) curable, or water-based with catalyst additives to prevent dissolvability in water. Depending upon the porosity of the substrate material and the properties of the ink used, some of the ink may be absorbed into the substrate material as part of or during the printing process.

In FIG. 1B, Liquid 106 (represented by the arrows), such as water, is applied to Liquid Soluble Substrate 102 and Surface 100 in such a quantity, and at such a temperature, and at such a pressure so as to be absorbed by Liquid Soluble Substrate 102 in a sponge-like fashion. The combination of quantity, temperature, and pressure and velocity of Liquid 106 may be quite varied from one situation to another in order to cause Liquid Soluble Substrate 102 to adhere to Surface 100, which is the desired end of the invention. Any one of these factors, or a combination of two or more of these factors, may, in any given situation, cause Liquid Soluble Substrate 102 to dissolve and break up, rather than just absorb, and therefore not adhere to Surface 100. For example, if the liquid is applied with too much pressure and velocity, Liquid Soluble Substrate 102 will begin to start to dissolve and break up. A large quantity of liquid, even if applied with low pressure and velocity, may cause Liquid Soluble Substrate 102 to dissolve and break up. All of these factors need to be evaluated for any given situation in order to avoid dissolving and breaking up Liquid Soluble Substrate 102 during the application process. When the combination of these factors are appropriate for a given situation, Liquid Soluble Substrate 102 absorbs Liquid 106 like a sponge and does not break up.

After Liquid 106 has been applied and absorbed by Liquid Soluble Substrate 102, Liquid 106 is allowed to evaporate (indicated by the reverse direction of the arrows) from Liquid Soluble Substrate 102 as shown in FIG. 1C. As Liquid 106 evaporates, Liquid Soluble Substrate 102 begins to conform and adhere to Surface 100. When Liquid Soluble Substrate 102 absorbs liquid, the fibers of the substrate expand and lift from the surface. This expansion of the fibers allows it to stretch and thereby become temporarily flexible, allowing it to take on the shape of the surface so that as it dries and shrinks, the substrate conforms and adheres to the surface through a mechanical interlock therewith. Once completely dried, based upon the local conditions of temperature, barometric pressure, and humidity, Liquid Soluble Substrate 102 with Ink Images 104 is adhered to Surface 100 due to cohesive forces between Liquid Soluble Substrate 102 and Surface 100.

For different applications, variations in the substrate used can augment the success of the application. Some applications may need a substrate with a faster drying time. Others may require greater durability to hold up to light rain or high humidity which may be accomplished through a substrate with a different chemical composition or an applied surface treatment. Thicker or thinner gauges of paper may be required to better conform to the particular surface.

Liquid Soluble Substrate 102 will remain adhered to Surface 100 until such time as a sufficient quantity of liquid at a sufficient temperature and sufficient pressure and velocity for the given conditions will cause Liquid Soluble Substrate 102 to break up and dissolve, and Ink Images 104 will wash away with the liquid, restoring Surface 100 to its condition prior to the application of Liquid Soluble Substrate 102. For example, a light rainfall may not have a deteriorating effect upon an outdoor application, whereas a heavy rainfall, or wind-driven rain of sufficient volume may be enough to dissolve Liquid Soluble Substrate 102.

When Surface 100 is subject to wear and tear, general friction will also cause Liquid Soluble Substrate 102 to break down and either fade or begin to tear away (i.e., the tensile strength of Liquid Soluble Substrate 102 is such that it breaks off or rips from friction). Various types of material used for Liquid Soluble Substrate 102, such as paper or plastic, will have different tensile strengths, and based upon the traffic or wear and tear expected, a suitable material may be chosen for Liquid Soluble Substrate 102 such that the image will remain for the desired period of time.

In the example shown in FIGS. 1A, 1B, and 1C, the printed image on Liquid Soluble Substrate 102 is that of fine text or half-tone printing. The liquid applied to the top surface of Liquid Soluble Substrate 102 is absorbed underneath Ink Images 104 due to the spaces between the dots of ink characteristic of half-tone printing, and the spaces surrounding the fine text printing (not shown) comprising Ink Images 104. With certain types of printed images, such as large text, or solid full-tone images, the liquid insoluble ink used to form Ink Images 104 acts as a barrier to absorption by the applied liquid. For such situations, Liquid 106 is applied to Surface 100 prior to positioning Liquid Soluble Substrate 102 on Surface 100 such that Liquid 106 is absorbed from the bottom side of Liquid Soluble Substrate 102. If necessary, more Liquid 106 may be applied to the top surface of Liquid Soluble Substrate 102 after positioning to enhance the application process so long as Liquid Soluble Substrate 102 does not start to dissolve.

Figure 2A:
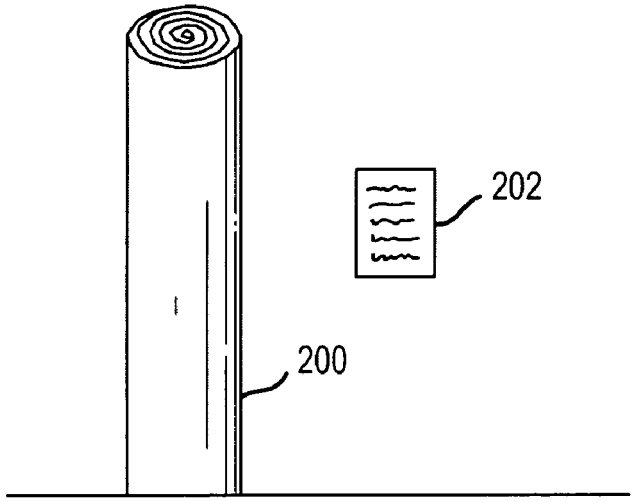
FIGS. 2A and 2B show a liquid soluble substrate having images printed with liquid insoluble ink conforming to the shape of the surface it is applied in an embodiment of the present invention.
Figure 2B:
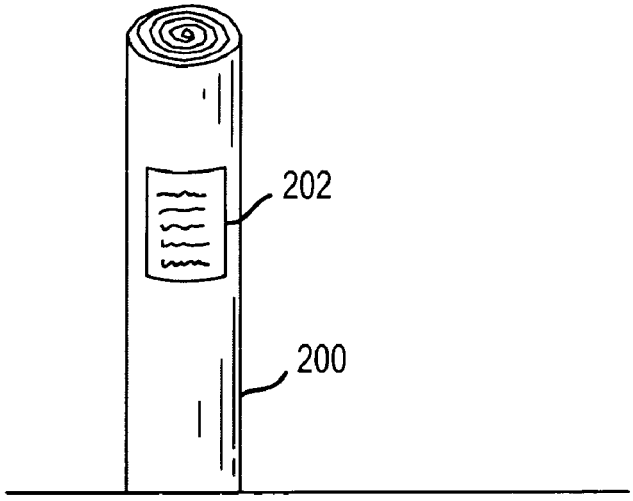

FIGS. 2A and 2B show a liquid soluble substrate having images printed with liquid insoluble ink conforming to the shape of the surface it is applied in an embodiment of the present invention. Referring now to FIG. 2A, Telephone Pole 200 is cylindrical in shape. Handbill 202 is a liquid soluble paper having text printed on it with a liquid insoluble ink. A person (not shown) places Handbill 202 on Telephone Pole 200. The person may use tacks, nails, staples, etc. to affix temporarily Handbill 202 in the desired location and orientation on Telephone Pole 200. Handbill 202 may also have a thin layer of adhesive on the non-printed side which will allow Handbill 202 to be affixed temporarily to Telephone Pole 200. The adhesive layer is very useful for vertical applications or applications on a ceiling or surface where gravity, or even wind, would tend to keep the liquid soluble substrate from staying in place during the application process. The person may also just hold Handbill 202 in the desired location and orientation during the application process.

Different types of adhesives may also be employed based upon the application, such as a quicker drying adhesive, or an adhesive that more quickly dissolves when applied to a wet surface, and then dries quickly thereafter. Water-based emulsion adhesives are suitable for this purpose. A backing or release liner may be used to mask the adhesive so that the material does not stick to itself (e.g., when the substrate is in rolls or stacked in sheets one on top of the other). The release liner can be made of any suitable material that prevents the adhesive from bonding prematurely.

The person, or another person, then applies a liquid to the surface of Handbill 202 as describe above so as to not cause the liquid soluble substrate to dissolve, but applies enough liquid to allow sufficient absorption of the liquid. As discussed above, liquid may also be applied to the surface of Telephone Pole 200 prior to positioning Handbill 202. The liquid is allowed to evaporate while Handbill 202 is secured in place on Telephone Pole 200 by the person, or by the nails, tacks, or adhesive, etc.

Examples of other applications include applying the liquid soluble substrate having images printed with liquid insoluble ink on a sidewalk or tennis court for advertising purposes. Another application can be for use on a playground or parking lot for use as a temporary court or game. For example, rather than being a solid sheet or series of panels as used in billboard advertising, the liquid soluble substrate with liquid insoluble ink images could be in the form of a tape on a roll that is used to temporarily mark out the boundaries of a tennis court or basketball court. The markings can later be washed away so that the playground or parking lot is restored to its original condition for its original use.

FIG. 2B shows that after the liquid has evaporated, Handbill 202 is adhered to Telephone Pole 200 and has conformed to the shape of Telephone Pole 200.

Figure 3A:
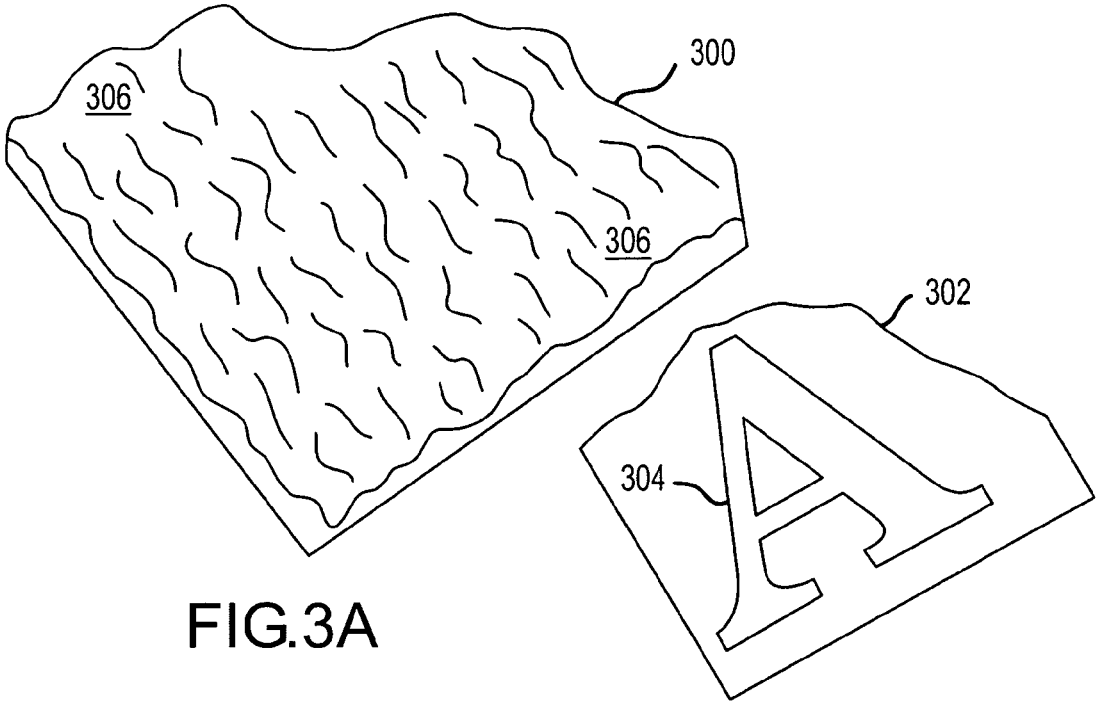
FIGS. 3A and 3B show an enlarged section of a portion of the liquid soluble substrate having images printed with liquid insoluble ink and a portion of the surface it is applied as shown in FIGS. 2A and 2B in an embodiment of the present invention.
Figure 3B:
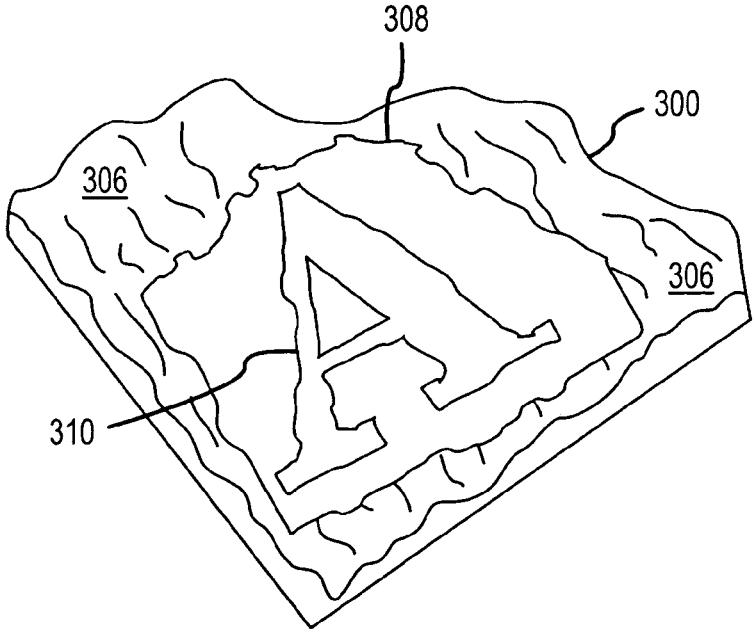

FIGS. 3A and 3B show an enlarged section of a portion of the liquid soluble substrate having images printed with liquid insoluble ink and a portion of the surface it is applied as shown in FIGS. 2A and 2B in an embodiment of the present invention. Referring now to FIG. 3A, Surface Section 300 represents a small surface portion of Telephone Pole 200 (FIGS. 2A and 2B), which indicates the rough, uneven Texture 306 of a typical telephone pole. Handbill Section 302 represents a small portion of the lower left hand corner of Handbill 202 (FIGS. 2A and 2B) having the letter "A" as an Ink Image 304. Handbill Section 302 is shown prior to being applied to Surface Section 300, and prior to wetting with a liquid.

FIG. 3B shows Handbill Section 302 after it has been applied to Surface Section 300, and after liquid has been applied and after the liquid has evaporated, as Handbill Section 306. Not only has Handbill Section 306 conformed to the shape of Telephone Pole 200 as shown in FIG. 2B, but it has also conformed to Texture 306 of Surface Section 300. Ink Image 304 has also conformed to Texture 306 of Surface Section 300 and is shown as Ink Image 310 in FIG. 3B.

The method and system for temporarily adhering an image to a surface of the present invention has numerous applications. For example, the method and system of the present invention could be applied in advertising to the hundreds of thousand of billboards in service in this country, as well as around the world. For extended outdoor uses, a light layer of a coating, varnish, or other surface treatment may be applied to waterproof the surface so that normal rainfall will not cause the liquid soluble substrate to dissolve, yet allow the billboard to be "erased" for a new ad by a pressurized liquid sprayer, squirter, hose, or through application of a substance that will first dissolve the surface treatment, thus allowing the liquid, or some other liquid such as water, to then dissolve the liquid soluble substrate. The coating or varnish may also be UV (ultra-violet) biodegradable such that over time, e.g., 30 days, the coating degrades, thereby allowing the substrate to dissolve with conventional application of water, or even rain of a sufficient velocity and volume.

Besides billboards, the method and system of the present invention may be applied to sidewalks, the sides and roofs of buildings, basketball courts, tennis courts, poles, trees, fences, windows, ceilings, automobiles, trucks, train cars, airplanes, and literally any other accessible surface. Special UV (ultra-violet) inks may be used for outdoor applications. Sunlight causes the UV ink to harden or cure, becoming plastic-like, and thus increasing the integrity of the image and lengthening its brilliance and durability.

Figure 4:
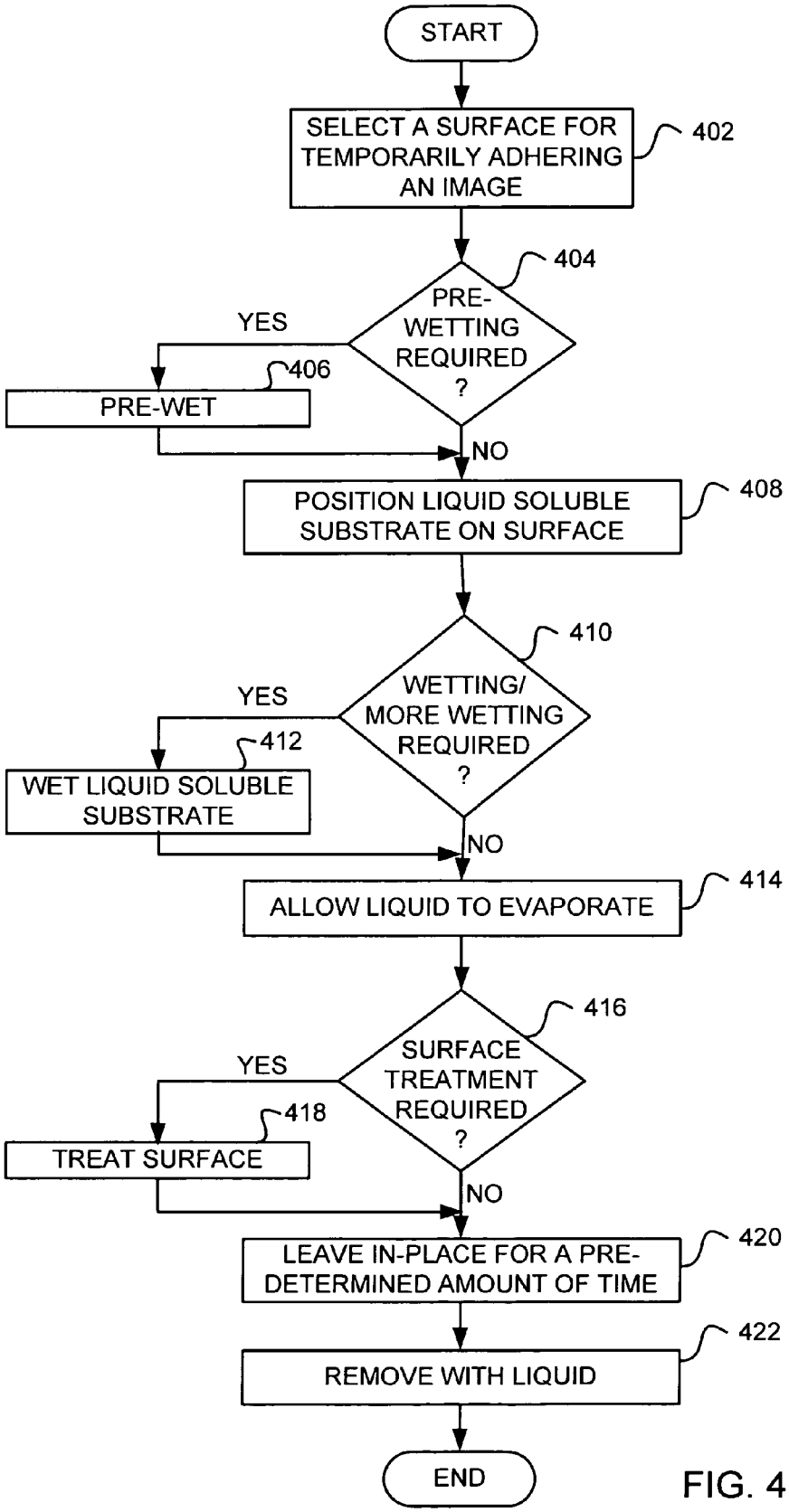
FIG. 4 shows a block flow diagram of an embodiment of the method of temporarily adhering an image to a surface of the present invention.

FIG. 4 shows a block flow diagram of an embodiment of the method of temporarily adhering an image to a surface of the present invention. Referring now to FIG. 4, a surface is selected in step 402 for temporarily adhering an image, such as a sidewalk, billboard, parking lot, pole, etc. In step 404 a determination is made, based upon the nature of the liquid insoluble image on the liquid soluble substrate, if the surface needs to be wetted prior to positioning the liquid soluble substrate on the surface. If yes, then in step 406 the surface is pre-wetted with the liquid. If not, then control flows to step 408.

In step 408, with or without pre-wetting, the liquid soluble substrate is positioned on the surface at the desired location and orientation. A liquid soluble substrate with an adhesive backing may be used for vertical or semi-vertical surfaces, whereas a horizontal or semi-horizontal surface would not require an adhesive backing, but could be used if desired. The liquid soluble substrate could also be tacked, nailed, stapled, etc. A determination is made in step 410 if an additional wetting, or the initial wetting is required. If yes (either an additional wetting or the initial wetting) then in step 412 liquid is applied to the liquid soluble substrate. If not, then control flows to step 414.

In step 414 the liquid used to wet the liquid soluble substrate and/or the surface is allowed to evaporate. As the liquid evaporates, the fibers of the liquid soluble substrate, which stretched and expanded and lifted from the surface during absorption, takes on the shape and texture of the surface as it dries and shrinks so that the substrate conforms and adheres to the surface through a mechanical interlock therewith. Once completely dried, based upon the local conditions of temperature, barometric pressure, and humidity, the liquid soluble substrate with the liquid insoluble image adheres to the surface due to cohesive forces between the two.

Step 416 determines, based upon the application, if a surface treatment needs to be applied to the liquid soluble substrate with the liquid insoluble image. Such a surface treatment may include, but is not limited to, a coating or varnish that may help to waterproof the liquid insoluble image or protect it from fading. If yes, then in step 418 the surface treatment is applied. If not, then control flows to step 420. In some applications, the surface treatment may be applied at the beginning of or during evaporating step 414.

In step 420, with or without surface treatment, the liquid insoluble image on the liquid soluble substrate is allowed to remain on the applied surface for a predetermined period of time. The time period will vary from application to application. For example, for billboard space, the advertising image placed on the billboard may be placed for a week, several weeks, or months at a time. Advertising may be placed on a tennis court surface during the course of a tournament, or for just one match. Once the time period has expired, then in step 422 the liquid soluble substrate with the liquid insoluble image is removed. A liquid is applied, typically water, at a sufficient quantity at a sufficient temperature and sufficient pressure and velocity for the given conditions to cause the liquid soluble substrate to dissolve, washing away the liquid insoluble image, and thus restoring the surface to its condition prior to the application of the liquid soluble substrate. If a coating or varnish has been applied, a substance designed to break down the coating or varnish may be applied first, followed by a removing liquid, such as water. The method of the present invention thus ends. The surface is now ready to receive a new image, and the method of the present invention may be repeated.

Figure 5:
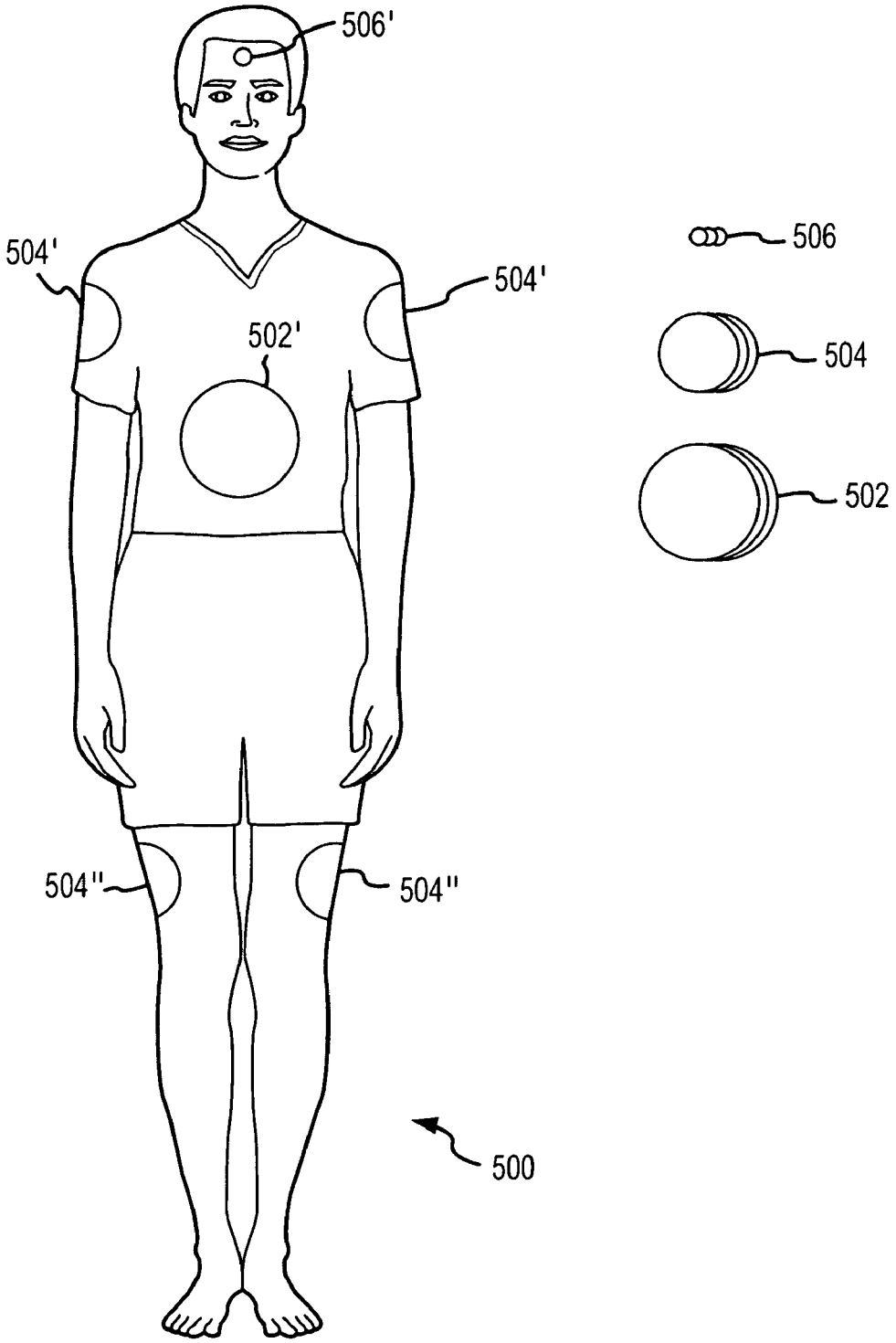
FIG. 5 shows an embodiment of the method of temporarily adhering an image to a surface of the present invention where the surface is the human body or clothing for the purpose of playing a game.

FIG. 5 shows an embodiment of the method of temporarily adhering an image to a surface of the present invention where the surface is the human body or clothing for the purpose of playing a game. Referring now to FIG. 5, in this embodiment of the invention, a liquid soluble substrate, in the shape of targets, has images printed with liquid insoluble ink. The targets are then adhered temporarily to the human body, skin or clothing, for the purpose of playing a game. The targets may be of any suitable shape, such as round, square, rectangular, triangular, elliptical, diamond, star-shaped, heart-shaped, and the like. The images printed may be of any type of design or text or both and with single or multiple colors, but preferably with a single dominant color.

In one game that utilizes the present invention called Splash Tag™, typically two teams are formed, Team One and Team Two, where each team has one or more individuals who make up each team. More than two teams may be formed, in which case each team is pitted against each of the other teams. In preparation for play, members of Team One apply a plurality of targets to their bodies, preferably of a first dominant color and/or design. Members of Team Two also apply a plurality of targets to their bodies, preferably of a second dominant color and/or design in order to more readily distinguish the members of Team One from the members of Team Two. If additional teams are formed, additional dominant colors and/or designs are typically used to distinguish each member of a team from all other members of all other teams. Team Member 500 of FIG. 5 is exemplary of team members from either Team One or Team Two or any additional teams. A plurality of different size targets, by way of example, but not limited to, Large Targets 502, Medium Targets 504, and Small Targets 506 may be temporarily adhered to Team Member 500 through wetting as described above in reference to the description of FIGS. 1–4. In an alternative embodiment, Large Targets 502, Medium Targets 504, and Small Targets 506 have an adhesive back side which allows them to be adhered to Team Member 500 without wetting. The adhesive back side may be protected with a backing that must be removed before the target can be adhered to the body. Such backings are well known in the art, such as a crack-and-peel type backing. Once the protective backing is removed, the target is positioned on the desired location of the body and then pressed onto the body, causing the target to conform and adhere to the body. With either method of adhering, the targets may be applied directly to skin or to whatever clothing Team Member 500 is wearing, such as the shirt and swim trunks shown in FIG. 5.

By way of example, Large Targets 502 may be applied to the stomach area, shown applied as Large Target 502', and applied to the back area (not visible) of Team Member 500. Medium Targets 504 may be applied to the left and right shoulder areas, shown applied as Medium Targets 504', and may be applied to the left and right thigh areas, shown applied as Medium Targets 504" of Team Member 500. Small Targets 506 may be applied to the forehead area, shown applied as Small Targets 506', and may be applied to the back of the neck (not visible) of Team Member 500.

Splash Tag™ is played in a manner similar to laser tag, paint ball, or capture the flag, or in a fashion that combines elements from two or more of these games. Each team member of Team One, Team Two, and any additional teams is equipped with one or more liquid shooting/squirting devices, such as squirt guns, squirt bottles, large capacity "super soaker" or "blaster" type squirt guns, and the like. Water is a typical, safe, and easily obtainable liquid that may be used with the shooting/squirting devices. However, any other suitable liquid compatible with the shooting/squirting devices that will react with the targets could be used.

The object of the game is for each team member to pursue and shoot liquid at the targets adhered to the body of an opposing team member, the liquid causing the targets to dissolve when hit. Once a team member has had all of his or her targets dissolved from his or her body, the team member is out of the game and cannot shoot at anyone else. A team wins when all of the team members from all of the other teams have been eliminated from the game. Team members are free to move about within the predetermined area of play in order to pursue opposing team members so as to shoot their targets, or to evade opposing team members to avoid the loss of one's own targets.

Additionally, one or more of Large Targets 502, Medium Targets 504, and Small Targets 506 corresponding to the dominant color/design designation of Team One and Team Two and any additional teams may be adhered to surfaces of objects within the predetermined area of play. For example, each team may have an area designated as their home base with targets placed on the surface of the home base. In addition to eliminating the targets from the bodies of team members, the targets placed on the surface of objects of the home base must also be eliminated. The targets may be adhered to a variety of surfaces serving as the home base, including by way of example, but not limited to, glass, concrete, brick, asphalt, plastic, vinyl, metal, wood, chain link fence, rock, and the like.

By varying the level of ink coverage and pattern of ink application, the solubility of the substrate material can be varied, both in the time it takes to dissolve, and also the amount of water required to make the target dissolve. Various surface coatings may also be applied to affect the solubility of the targets. Thus, the number of hits and amount of water applied to completely dissolve a target can be adjusted to make it harder or easier to dissolve a target. The targets may also be treated so that they glow in the dark for night-time play. Many other variations of game play and game rules may be added, such as the ability of a team member to earn back one or more of his or her targets that have been dissolved. For example, a team member may earn back a target by eliminating an opposing team member, or for eliminating one or more home base targets from an opposing team's home base.

In another embodiment of the invention, the targets may not react by dissolving when hit with the liquid, but instead react by changing color. Targets constructed with materials having thermo-chromatic or hydro-chromatic properties will change color when hit by the liquid. A thermo-chromatic material, when adhered to the body of a team member, will be at a temperature substantially the same as the skin temperature of the team member. The liquid, typically being several tens of degrees cooler than skin temperature, will cause the thermo-chromatic material to change color upon coming into contact with the thermo-chromatic material of the target. The temperature differential between the target and the liquid need only be the minimum differential at which the thermo-chromatic effect will take place. A team member is eliminated when all of the targets on the team member have changed color. Similarly, a hydro-chromatic material will change color simply when contacted by a liquid.

Many other types of games may also be played utilizing the targets of the present invention by dissolving the targets with liquid. Aspects of the various games may revolve around one or more of accuracy, speed, distance, accumulating points, eliminating opposing players, and the like. The other games may involve teams, one on one, or single individuals playing alone.

Having described the present invention, it will be understood by those skilled in the art that many and widely differing embodiments and applications of the invention will suggest themselves without departing from the scope of the present invention.

What is claimed is:

1. A method for using a liquid reactive material in a game, the method comprising:

(a) adhering at least one first target made of the liquid reactive material to at least one member of a first team, wherein said adhering step comprises:

(a1) positioning said at least one first target on a first selected portion of a body of said at least one member of said first team;

(a2) wetting said at least one first target; and (a3) allowing said wetted said at least one first target to evaporate, wherein said at least one first target conforms and adheres to said first selected portion of said body of said at least one member of said first team;

(b) adhering at least one second target made of the liquid reactive material to at least one member of a second team;

(c) equipping each of said at least one member of said first and second teams with at least one liquid shooting device;

(d) shooting a liquid by said at least one member of said first team with said at least one liquid shooting device at said at least one member of said second team, wherein said at least one second target made of the liquid reactive material will begin to react when hit with said liquid; and (e) shooting a liquid by said at least one member of said second team with said at least one liquid shooting device at said at least one member of said first team, wherein said at least one first target made of the liquid reactive material will begin to react when hit with said liquid, and further wherein said liquid reactive material is a one of a thermo-chromatic material, a hydro-chromatic material, and a liquid soluble substrate material, wherein said liquid soluble substrate material has images printed thereon with a liquid insoluble ink.

2. A method according to claim 1 further comprising:

(f) repeating steps (d) and (e) until a one of said at least one member of said first team and said at least one member of said second team has all of said at least one first target and said at least one second target completely reacted, eliminating said at least one member of said first team or said at least one member of said second team from the game.

3. A method according to claim 2 further comprising:

(g) repeating step (f) until all of said at least one member of said first team or said at least one member of said second team has been eliminated from the game.

4. A method according to claim 1 wherein said thermo-chromatic material is at a temperature differential with respect to said liquid such that said thermo-chromatic material will change color when hit with said liquid.

5. A method according to claim 1 wherein said hydro-chromatic material when hit with said liquid will change color.

6. A method according to claim 1 wherein said at least one first target is a first color and said at least one second target is a second color, said first color being different from said second color.

7. A method according to claim 1 wherein said at least one liquid shooting device is a one of a squirt gun, a squirt bottle and a large capacity squirt gun.

8. A method according to claim 1 wherein when said liquid soluble substrate material is hit with said liquid, said liquid soluble substrate material begins to dissolve.

9. A method according to claim 1 wherein steps (a1) through (a3) are repeated for a second selected portion of said body of said at least one member of said first team, wherein a next of said at least one first target is of a different size.

10. A method according to claim 1 wherein step (b) comprises the following steps (b1) through (b3):

(b1) positioning said at least one second target on a first selected portion of a body of said at least one member of said second team;

(b2) wetting said at least one second target; and (b3) allowing said wetted said at least one second target to evaporate, wherein said at least one second target conforms and adheres to said first selected portion of said body of said at least one member of said second team.

11. A method according to claim 10 wherein steps (b1) through (b3) are repeated for a second selected portion of said body of said at least one member of said second team, wherein a next of said at least one second target is of a different size.

12. A method according to claim 1 wherein step (a) comprises the following steps (a1) through (a3):

(a1) removing a protective backing from said at least one first target;

(a2) positioning said at least one first target on a first selected portion of a body of said at least one member of said first team; and (a3) pressing said at least one first target to said first selected portion of said body of said at least one member of to said first team, wherein said at least one first target conforms and adheres to said first selected portion of said body of said at least one member of said first team.

13. A method according to claim 12 wherein steps (a1) through (a3) are repeated for a second selected portion of said body of said at least one member of said first team, wherein a next of said at least one first target is of a different size.

14. A method according to claim 1 wherein step (b) comprises the following steps (b1) through (b3):

(b1) removing a protective backing from said at least one second target;

(b2) positioning said at least one second target on a first selected portion of a body of said at least one member of said second team; and (b3) pressing said at least one second target to said first selected portion of said body of said at least one member of said second team, wherein said at least one second target conforms and adheres to said selected portion of said body of said at least one member of said second team.

15. A method according to claim 14 wherein steps (b1) through (b3) are repeated for a second selected portion of said body of said at least one member of said second team, wherein a next of said at least one second target is of a different size.

16. A method according to claim 1 wherein step (a) comprises the following step (a1) and step (b) comprises the following step (b1):

(a1) adhering said at least one first target made of the liquid reactive material to a surface of a home base of said first team; and (b1) adhering said at least one second target made of the liquid reactive material to a surface of a home base of said second team.

17. A method according to claim 16 wherein said surface of a home base of said first team and said surface of a home base of said second team is a one of glass, concrete, plastic, vinyl, metal, wood, chain link fence, and rock.

* * * * *

UNITED STATES PATENT AND TRADEMARK OFFICE

CERTIFICATE OF CORRECTION

PATENT NO. : 6,966,557 B2
DATED : November 22, 2005
INVENTOR(S) : Kirk et al.

It is certified that error appears in the above-identified patent and that said Letters Patent is hereby corrected as shown below:

Title page,
Item [73], Assignee, delete "Dissolve" and replace with -- Dissolvo --.

Column 1,
Line 12, delete "now allowed,".

Signed and Sealed this

Twenty-fourth Day of January, 2006

JON W. DUDAS
*Director of the United States Patent and Trademark Office*